United States Patent [19]

Grover

[11] Patent Number: 4,635,307

[45] Date of Patent: Jan. 13, 1987

[54] WATERBED

[76] Inventor: Todd C. Grover, 8595 N. Meadowside Ct., Milwaukee, Wis. 53223

[21] Appl. No.: 845,980

[22] Filed: Mar. 31, 1986

Related U.S. Application Data

[63] Continuation-in-part of Ser. No. 722,850, Apr. 12, 1985.

[51] Int. Cl.[4] ..... A47C 27/08

[52] U.S. Cl. ..... 5/451; 5/400

[58] Field of Search ..... 5/451, 452, 450, 400, 5/449, 474, 422

[56] References Cited

U.S. PATENT DOCUMENTS

| | | | |
|---|---|---|---|
| 4,145,781 | 3/1979 | Autrey et al. | 5/451 |
| 4,185,455 | 2/1980 | Fox et al. | 5/474 |
| 4,334,331 | 6/1982 | Santo | 5/451 |
| 4,393,531 | 7/1983 | Model | 5/451 |
| 4,506,397 | 3/1985 | Fogel et al. | 5/451 |
| 4,521,928 | 6/1985 | Stephenson | 5/400 |

*Primary Examiner*—Alexander Grosz

*Attorney, Agent, or Firm*—Peter N. Jansson, Ltd.

[57] ABSTRACT

An improved waterbed and waterbed perimeter support including a frame base member formed of a dimensionally-stable pliant sheet having a lower portion securable under the bladder and a lateral portion extending therefrom adjacent to the bladder perimeter along the sides thereof, rigid elongated reinforcing boards attached to each of the reinforcing portions and extending upwardly to an upper edge at an intermediate level beside the bladder perimeter, and resiliently-deformable elongated upper members extending along each of the boards and terminating in top edges along the bladder top. The upper members provide excellent lateral support for the bladder and are readily inwardly deformable.

18 Claims, 6 Drawing Figures

WATERBED

RELATED APPLICATION

This is a continuation-in-part of co-pending patent application Ser. No. 722,850, filed Apr. 12, 1985, entitled WATERBED now pending.

FIELD OF THE INVENTION

This invention is related generally to waterbeds and, more particularly, to means for supporting the perimeters of flexible water-filled bladders used in waterbeds.

BACKGROUND OF THE INVENTION

Waterbeds have recently become a popular alternative to conventional beds because of their superior relaxation-inducing properties. Waterbeds have flexible bladders filled with water. A body supported by such a water-filled bladder displaces fluid in the bladder until an equilibrium condition is established to provide support of essentially uniform pressure on all portions of the body in contact with the bed.

Since the bladder is flexible, "bottoming out" can be a problem unless steps are taken to maintain the bladder top at a sufficiently high level above the bladder bottom. While this can be done by filling the bladder with an exceptionally large volume of water, the more reasonable and generally accepted approach has been to laterally support the bladder about its perimeter to hold the bladder top at the desired height.

A number of different types of lateral bladder supports have been used, and much of the development work in the field of waterbeds has been directed toward improvement of lateral bladder supporting apparatus. But significant problems regarding lateral support of water bladders have remained unsolved.

And it is clear that because of this the waterbeds of the prior art, including those on the market today, have major drawbacks which are recognized by the public. These drawbacks have limited the growth of the waterbed segment of the bedding market.

The lateral support most often used for a water bladder is a rigid wooden or plastic frame surrounding the upper flat surface of the deckboard which supports the water bladder on top of a pedestal. In these "sand-box" structures, the level of the bladder top surface is at or just below the upper edges of the rigid frame members.

Often, a watertight safety liner is placed between the bladder and the sand-box surfaces. Safety liners are required by law in many different states to retain the water in the event of leakage from the bladder and guard against the damage which could be caused to a building by major waterbed leakage. Such safety liners often also serve as insulating layers to help retain heat which has accumulated in the liquid.

While such sand-box structures support bladder perimeters and safety liners very well, they have some significant drawbacks. Getting in and out of such waterbeds and sitting on the sides are very uncomfortable exercises. For example, in getting out of the bed, the bladder naturally is depressed where one sits and it remains necessary to scale the wall which at that point is well above the level of the used portion of the bladder. In addition, having a bulky frame is somewhat contradictory to the advantage of collapsibility often ascribed to waterbeds.

Thus, efforts have been directed at eliminating the sand-box frame and at making waterbed mattresses more nearly like regular mattresses in the support they provide near their edges.

Such efforts have led to so-called "flotation systems," which are more than just a simple water bladders. Such flotation systems, while sometimes solving the aforementioned problems associated with sand-box type waterbed frames, themselves have distinct problems and disadvantages.

The common factor in all flotation systems appears to be the addition of substantial bulk around the perimeter of the water bladder to provide a water-free weight supporting surface along the bladder perimeter and to confine and support the bladder perimeter. Such additional bulk, which may be in a variety of forms, often comes as part of a mattress structure having a water bladder as its principal central element. Such bladders are often much smaller than standard waterbed bladders in order to make room for the additional bulk, and thus desirable flotation surface area is sacrificed.

One type of flotation system is an air-framed or perimeter chamber waterbed, in which an air-inflated annular member having one or more air compartments is secured, preferably by means of fluid-tight seals, to the perimeter of the water bladder. U.S. Pat. Nos. 3,778,852; 3,787,907; 3,918,110; 4,150,447; 4,491,993; and 4,501,036 are examples of such prior waterbeds.

Integrity problems arise in such systems because air is difficult to contain. And, because the air chambers are often formed with seals against the water bladder, strains are exerted on specific portions of the bladder and the risk of bladder rupture is increased. Furthermore, such air-framed waterbeds typically cannot be used without safety liners; but, since they provide no way to hold a safety liner in place, such waterbed mattresses are often used with a sand-box frame to support them along with a safety liner. This defeats part of their original purpose.

Another type of flotation system, sometimes referred to as a "composite" or "hybrid" waterbed mattress, has a number of cushions and rigidly interconnected internal frame members surrounding a water bladder with other cushions or pads covering the entire mattress. The outward appearance of such mattresses is very much like that of typical inner spring mattresses. U.S. Pat. Nos. 4,062,077; 4,186,455; 4,187,567; and 4,371,998 are representative of composite waterbeds.

The composite waterbed mattresses severely reduce the water flotation surface available to the user, and their covering layers reduce the flotation effect even in their central areas. Furthermore, composite waterbed mattresses are more complex in construction and much more expensive than typical waterbeds.

In yet another kind of flotation system, sleeves are attached to the edges of the water bladder to slidably receive self-contained chambers filled with air or foam. In some cases, substantially rigid members extend through the chambers and are rigidly connected at their ends to the ends of similar rigid members extending through the chambers in the adjacent sleeves. U.S. Pat. Nos. 4,181,990 and 4,334,331 are examples of this kind of system.

In these sorts of waterbeds, the seals joining the sleeves to the water bladder place a direct stress on the bladder, particularly when the sleeves are sat upon, which, of course, is intended. Such stress will tend to weaken the water bladder. And, as with the above-described air-framed waterbeds, there is no convenient way to use a watertight safety liner with this kind of waterbed. Furthermore, the appeaance of such waterbeds leaves much to be desired.

Each of the aforementioned waterbeds and water mattress perimeter support systems has significant drawbacks. There has been a need for an improved waterbed and waterbed perimeter support.

SUMMARY OF THE INVENTION

This invention is an improved waterbed perimeter support means overcoming some of the problems and disadvantages of the prior art. The inventive perimeter support means includes a lower member and upper members. The lower member is secured under the edges of the water bladder and extends upwardly at the perimeter of the bladder to an intermediate level—between the level of the bottom of the bladder and the level of the top of the bladder. The upper members are attached to the lower member and extend upwardly at the bladder perimeter to the level of the top of the bladder.

The lower member includes two principal parts. This first part, which is referred to as a frame base member, is formed of a dimensionally-stable pliant sheet material (e. g., canvas). The second principal part, actually plural parts, are rigid elongated reinforcing boards attached to the frame base member (i. e., to the pliant sheet).

The pliant sheet material, which forms the frame base member, has a lower portion which, on all sides of the perimeter support, is securable under the bladder—between the bladder and the flat surface on which the bladder rests—and a lateral portion connected to the lower portion to extend upwardly therefrom adjacent to the bladder perimeter. The lower portion of the pliant sheet material is under the edges of the water bladder and is preferably held in place by the weight of the bladder. The lateral portion of the pliant sheet material, as noted, extends upwardly along the sides of the bladder to an intermediate level.

The rigid elongated reinforcing boards are attached to the lateral portion of the frame base member, each of such boards extending lengthwise along a side of the bladder perimeter and widthwise from a lower edge near the level of the flat surface on which the bladder rests upwardly to an upper edge at a level between such flat surface and the bladder top. Such elongated reinforcing boards have inside surfaces against which the upward force of the bladder is applied.

The combination of pliant dimensionally-stable frame base member and rigid elongated reinforcing boards which forms the lower member of the perimeter support of this invention provides a non-bulky structure which holds the water bladder firmly in place. The structure also serves as a mount for the upper members of the perimeter support which will now be described.

The upper members are resiliently-deformable elongated members extending lengthwise along each of the boards and widthwise upwardly from the boards to a top edge along the top of the bladder. In certain preferred embodiments the elongated upper members extend upwardly against the inside surfaces of the rigid reinforcing boards, and are connected to the boards near their lower edges.

The elongated upper members are each formed of a thin resiliently-deformable stiffener, which is an elongated strip (or thin board) in overlapping parallel relation with the rigid elongated reinforcing board to which it is attached. Each such resiliently-deformable stiffener preferably includes a proximal portion along its bottom edge which overlaps the rigid elongated reinforcing board to which it is attached and a distal portion which is above the overlapping portion and extends to a top edge at the level of the top of the water bladder.

Each resiliently-deformable upper member is bendable both inwardly and outwardly (that is, in a horizontal direction either toward or away from the normal edge position of the bladder). The outward force of the water bladder, near its upper edge, is supported by the distal portion of the upper elongated member, and this outward force is applied, through the upper elongated member, against the upper edge of the rigid elongated reinforcing board which it overlaps. And, the proximal and distal portions of each elongated upper member are inwardly bendable together (against the bladder upper edge) about the interconnection of the stiffener with the rigid board.

The inside surfaces of the rigid boards support the resiliently-deformable elongated upper members against outward pressure. This serves to support the upper portions of the bladder perimeter very well. However, the resiliently-deformable elongated upper members are more easily deformable in an inward direction, such as occurs when a person sits on the edge of the bladder. In such situations, the deformable upper member is not supported by the inside surface of the rigid reinforcing board in the same way that it is when outward pressure is applied. Instead, the support is by the interconnection of such resiliently-deformable upper member and rigid reinforcing board, which, as previously noted, is preferably near their common lower edges.

This varying interaction of the resiliently-deformable elongated members with the respective rigid elongated reinforcing boards to which they are attached provides a favorable combination of excellent perimeter support and perimeter support deformability.

In preferred embodiments, the resiliently-deformable elongated upper members include padding over their stiffener members along the upper edges thereof, and wrappers around the padding and stiffener. The wrappers are preferably dimensionally-stable pliant sheets, such as a fabric. The wrappers of adjacent upper members, that is the upper members along the sides of the typically rectangular bladder, are joined to each other or integrally formed at the corners of the perimeter support.

In the most preferred embodiments, stiff corner members are also included beneath the joined wrappers, and such corner members have a pair of perpendicularly oriented slots receiving the adjacent ends of stiffeners of adjacent members. Such stiffeners preferably are free to slide within such slots, which adds a degree of automatic adjustability for varying deformation pressures applied to the perimeter support at different points.

In preferred embodiments, the lateral portion of the dimensionally-stable pliant sheet which forms the frame base member has two layers forming a compartment along each side of the bladder. Each such compartment receives and holds one of the rigid elongated reinforcing boards. The boards may be tightly engaged in such compartments, with the pliant sheet tightly against the board surfaces, or may be held loosely within such compartments. The two layers of the dimensionally-stable pliant sheet forming such compartments are preferably of a single sheet turned back on itself along the upper edge of the contained rigid elongated reinforcing board.

The dimensionally-stable pliant sheet forming the frame base member preferably includes a skirt portion attached to the lateral portion at the connection between its lower and lateral portions. Such skirt provides a means to cover the edge of the decking on which the bladder is resting. Such deck typically rests on top of a pedestal which supports the bladder at an appropriate level above the ground. The lower portion of the dimensionally-stable pliant sheet forming the frame base member extends inwardly from the edge of such deck along the top thereof, and the skirt may be inserted between the bottom of the deck and the pedestal on which such deck rests. This serves to cover the edge of the deck, which is often rough.

The lower portion of the dimensionally-stable pliant sheet may terminate in a lower edge. In some cases, however, the lower portion may have no edge, but extend without interruption across the deck on which the water bladder rests. A watertight safety liner may be supported between the perimeter support of this invention and the water bladder.

The perimeter support of this invention preferably extends continuously along all four sides of the rectangular bladder perimeter. In some cases, however, a rigid headboard structure may replace the perimeter support along one side.

The waterbed perimeter support of this invention provides sufficient lateral support to the bladder to maintain its top surface at the desired uniform height. The problem of "bottoming cut" is eliminated without the use of a sand-box structure with all its attendant disadvantages. The waterbed of this invention is easy to get on and off and one may sit on the edge without encountering a hard rail.

These advantages are achieved without the use of the bulky perimeter support structures of the so-called flotation systems, such as the bulky air cushions of the air-frame waterbeds and the bulky and complex cushion-pad-rigid frame structures of the composite waterbeds. Therefore, the amount of available flotation surface is maximized in this invention.

This invention avoids the specific problems or disadvantages associated with various types of prior flotation systems, such as the problems of inadequate flotation effect, complexity and high cost of composite waterbeds, the problems of undue bladder stress and undesirable appearance of the sleeved systems, and the bladder integrity problems associated with air-frame waterbeds.

The waterbed and waterbed perimeter support of this invention are simple and inexpensive to manufacture. The water bladder requires no seals or connections to it to accommodate this invention, and thus its watertight integrity will not be compromised. And, this invention can have the appearance of a conventional bed.

The invention may come in the form of a complete waterbed or a retrofit apparatus which can be used with existing simple waterbed bladders, existing pedestals and deckboards, existing waterbed heaters, etc. Industry standards can be maintained while providing the advantages of this invention.

OBJECTS OF THE INVENTION

It is an object of this invention to provide an improved waterbed overcoming certain problems and disadvantages of the prior art.

Another object of this invention is to provide a waterbed perimeter support means which does not have the problems of other prior apparatus for that purpose.

Another object of this invention is to provide a perimeter support means making a waterbed easy to get on and off and comfortable for edge sitting.

Another object of this invention is to provide a comfortable waterbed which is simple and inexpensive.

Yet another object of this invention is to provide a waterbed with the aforementioned advantages, but which maximizes the available flotation surface area.

Still another object of this invention is to provide a waterbed with the aforementioned advantages, but which has the appearance of a conventional bed.

Another object of this invention is to provide an inexpensive waterbed with the aforesaid advantages which permits the use of a safety liner without adding an external frame structure.

Another object of this invention is to provide a waterbed perimeter support means which may be retrofit with conventional waterbed bladders, pedestals and other standard equipment.

These and other objects will be apparent from the following additional descriptions and from the drawings, wherein:

DETAILED DESCRIPTION OF PREFERRED EMBODIMENTS

Figure 1:
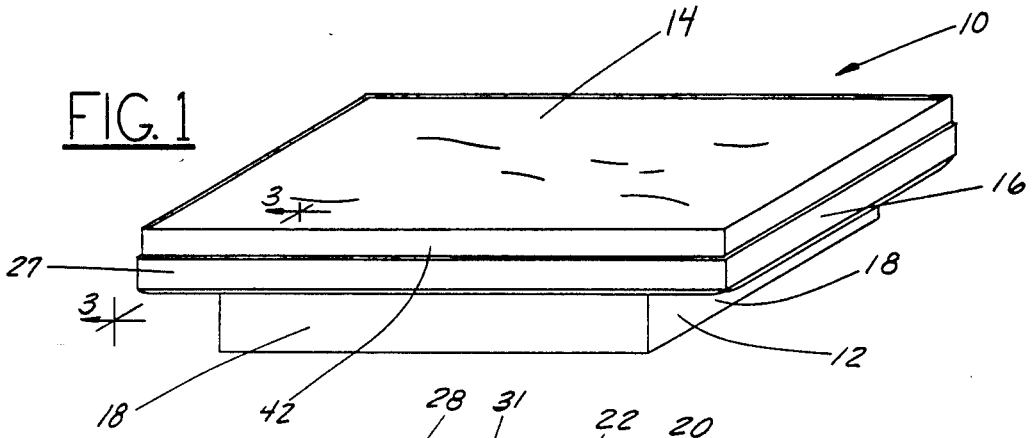
FIG. 1 is a perspective view of a preferred embodiment of this invention.

FIG. 1 illustrates a waterbed 10, including a pedestal 12, a deckboard 20 (not shown in FIG. 1), a water bladder 14, and a preferred perimeter support 16 in accordance with this invention.

Perimeter support 16 includes a lower member 27 and upper members 42. Lower member 27 is secured under water bladder 14 and extends upwardly along the edge of water bladder 14 to a level about midway between the level of the top of deckboard 20 and the level of the top of water bladder 14. Upper members 42 are attached to lower member 27 along each of the sides of water bladder 14.

Pedestal 12 is rectangular in shape, having four vertical sides 18. A deckboard 20 (see FIG. 3) rests on top of pedestal 12 and extends well beyond pedestal sides 18 on each side of waterbed 10. Deckboard 20 has a flat upper surface 22 supporting water bladder 14. Perimeter support 16 extends along the edges 34 of deckboard 20 and supports the edges of water bladder 14.

Perimeter support 16 has a frame base member which is formed of a dimensionally-stable pliant sheet material 24. "Dimensionally-stable" means that sheet material 24 does not stretch perceptibly or undergo significant dimensional change, either temporarily or permanently, when force is applied to it. This characteristic allows the frame base member to serve important support functions previously thought to require bulky, heavy and/or complex apparatus.

Many different sheet materials which meet the requirements of this invention are commercially available. Particularly useful are plastic materials which are reinforced with inelastic fibers. However, woven materials such as canvass or heavy nylon are also acceptable as are many other materials.

Examples of preferred materials for dimensionally-stable pliant sheet 24 include: a 1,000 Denier urethane-coated Cordura Nylon from Dupont, Wilmington, Del.; a 12 ounce flame-retardent vinyl laminate reinforced with polyester scrim, from ESC Industries, Whiteville, Tenn.; and a 12 ounce nylon-reinforced laminated vinyl from UniRoyal, Akron, Ohio. Other acceptable materials would be apparent to those skilled in the art who are made familiar with this disclosure.

Figure 2:
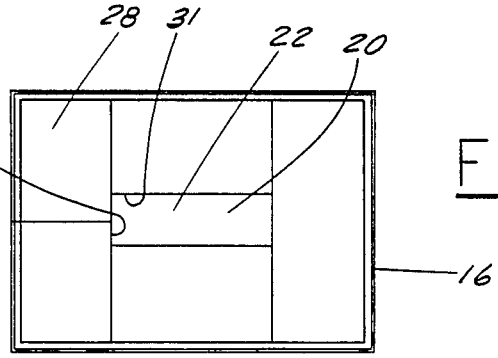
FIG. 2 is a reduced top plan view of FIG. 1, with the water bladder removed.

Pliant sheet material 24 extends continuously along all four sides of water bladder 14. Pliant sheet material 24 includes a lower portion 28 which extends to an inner edge 31. Lower portion 28 extends along the top of deckboard 20 and is secured in place by the weight of filled water bladder 14. Lower portion 28, in its position under water bladder 14, may be folded neatly at its corners in any organized manner, such as is illustrated in FIG. 2.

Pliant sheet material 24 also includes a lateral portion 29 connected to lower portion 28 and extending upwardly therefrom adjacent to the perimeter of water bladder 14. Rigid boards 26 are attached to lateral portions 29 of pliant sheet material 24. One board 26 is attached along each of the sides of water bladder 14. Boards 26 along adjacent sides of water bladder 14 are not directly connected one to another. Each such board 26 is rigid and elongated, and may be made of $\frac{3}{4}$ inch wood, a rigid plastic, or other similar material.

Each board 26 extends lengthwise along one side of the perimeter of water bladder 14, and extends widthwise from a lower edge 36 upwardly to an upper edge 38. Lower edge 36 is near the level of the upper surface of deckboard 20, and upper edge 38 is at a level between the level of the deckboard surface and the top of water bladder 14. Each of such boards 26 has an inside surface 40 against which the outward force of water bladder 14 is applied.

Figure 3:
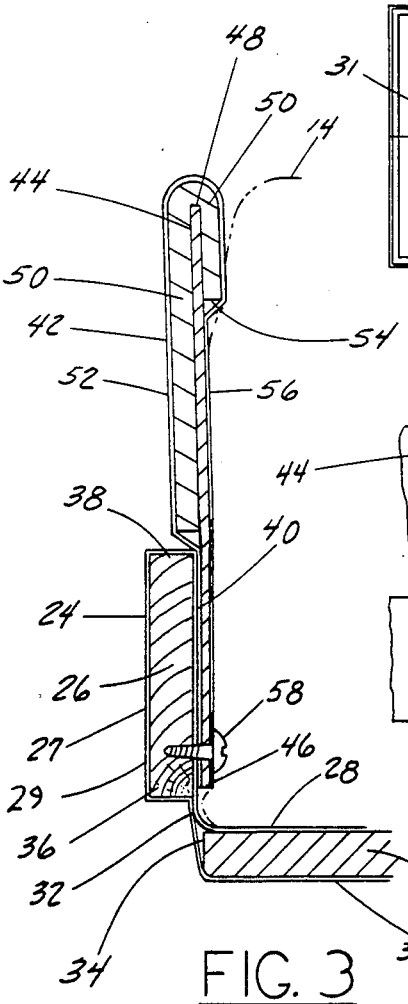
FIG. 3 is an enlarged framentary sectional view taken along section 3—3 as indicated in FIG. 1.

Pliant sheet material 24 is folded back on itself along upper edges 38 of boards 26 to form compartments receiving boards 26. The two layers of pliant sheet material 24 are joined together along juncture lines 32 (see FIG. 3) to form such compartments. As illustrated in FIG. 3, pliant sheet material 24 is tightly drawn about board 26. This is the manner in which boards 26 are attached to sheet material 24 in this preferred embodiment of the invention.

Extending downwardly from juncture line 32 is an additional portion of pliant sheet material 24 which forms a skirt 30. Skirt 30 may serve to cover deckboard edges 34, and thus improve the appearance of the waterbed of this invention. It is preferred that skirt 30 be pulled around deckboard edge 34 and secured in place between pedestal 12 and deck board 20. The securement of skirt 30 in this manner further holds the frame base member (formed by pliant sheet 24) firmly in the proper position.

Upper members 42 along each of the edges of perimeter support 16 include resiliently-deformable thin boards 44 as their principal structural members. Resiliently-deformable thin boards 44 are each mounted against inside surface 40 of one of the boards 26 along one side of water bladder 14. Each resiliently-deformable thin board 44 is in overlapping relation with its corresponding board 26, and has a bottom edge 46 substantially aligned with lower edge 36 of board 26. Each resiliently-deformable thin board 44 is connected to its respective board 26 by a straight horizontal row of screws 58 located near bottom edge 46 and lower edge 36. Screws 58 form the only interconnection of the overlapping (or proximal) portion of each resiliently-deformable thin board 44 with its respective board 26. A variety of other interconnection means could be used to form a firm connection line near bottom edge 46 and lower edge 36.

Each resiliently-deformable thin board 44 extends upwardly beyond upper edge 38 of its corresponding board 26 to a top edge 48 which is at the level of the top of water bladder 14. Thus, upper members 42 have a distal edges aligned near the top of water bladder 14.

Resiliently-deformable thin boards 44 are preferably formed of strips of low-density polyethylene, having a thickness on the order of $\frac{1}{8}$ inch. The material used for this purpose should be deformable, tough and resilient, and have sufficient rigidity to serve a perimeter-supporting function with respect to bladder 14. A wide variety of materials, particularly plastics, are suitable for this purpose and appropriate choices would be apparent to those skilled in the art who are familiar with this invention.

A layer of padding 50 extends over top edge 48 of each resiliently-deformable thin board 44, as illustrated in FIG. 3. Padding layer 50 is held in place by a cloth wrap 52 which extends from bottom edge 46 up and over thin board 44 and padding 50 and down the opposite side of thin board 44. Padding layer 50 may also be held by adhesive (such as adhesive spots, strips or the like) to the opposite surfaces of thin board 44 to prevent slippage. Cloth wrap 52 preferably extends continuously around perimeter support 16, while resiliently-deformable thin boards 44 are preferably not firmly interconnected at their adjacent ends.

Figure 4:
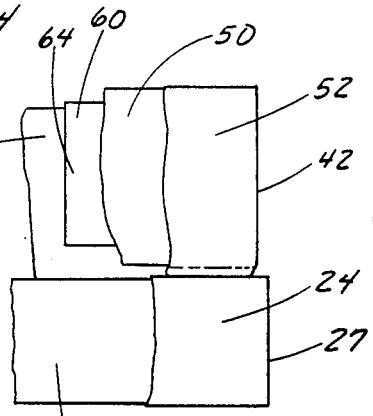
FIG. 4 is an enlarged, partially cut-away, fragmentary elevation of a corner portion of FIG. 1.
Figure 6:
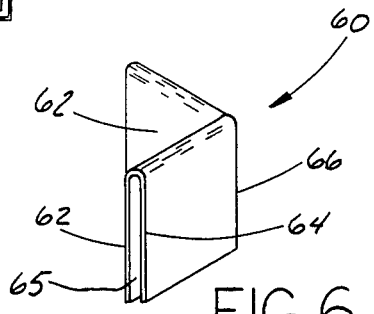
FIG. 6 is a perspective view of a preferred corner element.

Instead, adjacent ends of resiliently-deformable thin boards 44 along adjacent sides of perimeter support 16 are received in a corner piece 60, illustrated best in FIGS. 4 and 6. Each corner piece 60 is a substantially rigid right-angled piece having spaced inside and outside flat members 62 and 64 forming a pair of slots 65 which are perpendicular to one another and converge on a corner 66. The adjacent ends of adjacent resiliently-deformable thin boards 44 are received in slot 65 and are freely slideable therein, within the limitations imposed by cloth wrap 52.

To allow insertion of the ends of thin boards 44 into slots 65, padding layer 50 is not glued or otherwise directly attached to thin boards 44 near the ends thereof. FIG. 4 shows padding layer 50 loosely overlying outside flat member 64 of corner piece 60, with resiliently-deformable thin board 44 underlying outside flat member 64 in slot 65. This corner structure, with free movement of thin boards 44 in slots 65, accommodates the deformation of upper members 42 without putting undue strain on any element of the structure.

Padding layer 50, along the inside surface of resiliently-deformable thin boards 44, terminates in an inside edge 54 which is nearer to top edge 48 of thin board 44 than it is to upper edge 38 of board 26. This configuration provides a slight additional space along the inside surface 56 of upper members 42 to receive lateral portions of bladder 14. This configuration helps improve the appearance of the waterbed of this invention.

Figure 5:
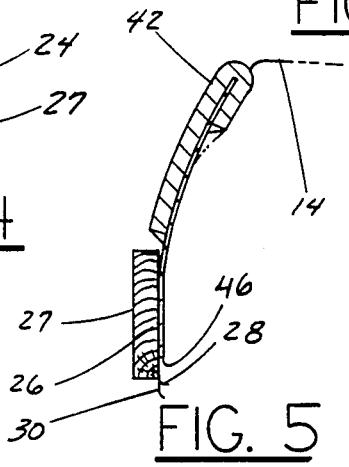
FIG. 5 is a sectional view as in FIG. 3, but in reduced schematic form and illustrating the configuration of the device of this invention when the sitting weight of a person is applied to the edge of the waterbed.

FIGS. 3 and 5 illustrate two different ways that upper members 42, particularly their resiliently-deformable thin boards 44, can be deformed. In FIG. 3, the outward pressure of water bladder 14 applies an outward force to inside surface 56 of each upper member 42, and upper member 42 is slightly bent in an outward direction. This bending occurs in the distal portions of upper members 42, and not in the overlapping proximal portions, which are supported by inside surfaces 40 of boards 26. The outward pressure of water bladder 14 causes bending of upper members 42 about upper edges 38 of boards 26.

When a person sits on the edge of waterbed 10, upper member 42 is bent inwardly at and near the point of sitting pressure, as illustrated in FIG. 5. The bending of upper member 42 is about at the point of interconnection of upper member 42 with board 26. Such point of interconnection is near bottom edge 46, and thus a greater pivoting radius is provided to accommodate the deformation of upper member 42 which is necessary for comfortable sitting and to maintain a pleasing appearance of waterbed 10.

A separate safety liner may readily be used with the perimeter support of this invention. Such a liner, which preferably has self-supporting vertical sides, would be held between perimeter support 16 and water bladder 14.

The waterbed of this invention is attractive. It allows the covering of the bed with blankets in a manner more typical for conventional beds than is possible with other types of waterbeds. Another advantage not previously discussed is that perimeter support 16 may easily be color coordinated with room furnishings. More specifically, an appropriate color or colors may be chosen for pliant sheet material 24 and cloth wrap 52. Decorative materials, such as velour, leather and vinyl can be added as desired.

The waterbed and waterbed perimeter support means of this invention may be made using well-known manufacturing techniques. Having read this specification, the person skilled in the art would be able to make this invention using such techniques.

While the principles of this invention have been described in connection with specific embodiments, it should be understood clearly that these descriptions are made only by way of example and are not intended to limit the scope of the invention.

What is claimed:

1. In waterbed perimeter support means of the type around the perimeter of a rectangular water bladder which rests on a flat surface, the improvement comprising:

a frame base member formed of a dimensionally-stable pliant sheet to extend continuously along at least three sides of the bladder perimeter, said sheet having a lower portion securable between the bladder and the flat surface and a lateral portion connected thereto to extend upwardly therefrom adjacent to the bladder perimeter;

rigid elongated reinforcing boards along to the lateral portion of the frame base member, each of said boards extending lengthwise along a side of the bladder perimeter and widthwise from a lower edge near the flat surface upwardly to an upper edge between the flat surface and the bladder top, said boards having inside surfaces against which the outward force of the bladder is applied, said lateral portion of the frame base member having two layers forming an compartment along each side, each said compartment substantially enveloping an holding one of the reinforcing boards, and resiliently-deformable elongated upper members extending lengthwise along each of the boards and widthwise upwardly from the boards to top edges along the bladder top.

2. The waterbed perimeter support means of claim 1 wherein the elongated upper members extend upwardly against the inside surface of said boards, the upper members being connected to the boards near the lower edges thereof.

3. The waterbed perimeter support means of claim 2 wherein the elongated upper members each include a thin resiliently-deformable stiffener, said stiffeners each including a proximal portion overlapping the board to which it is attached and a distal portion thereabove, said distal portion being bendable outwardly against the upper edge of said board and said proximal and distal portions together being bendable inwardly about the interconnection of the board and stiffener.

4. The waterbed perimeter support means of claim 3 wherein each of the upper members includes padding over the stiffener along the top edge and a wrapper around the padding and stiffener, the wrappers of adjacent upper members being joined at their common corners.

5. The waterbed perimeter support means of claim 4 further comprising stiff corner members beneath the joined wrappers, said corner members having a pair of slots receiving the stiffeners of adjacent upper members.

6. The waterbed perimeter support means of claim 5 wherein the stiffeners are freely slideable within the corner members.

7. The waterbed perimeter support means of claim 1 extending continuously along all four sides of the bladder perimeter.

8. The waterbed perimeter support means of claim 1 wherein the two layers of the lateral portion are formed of a single sheet turned back on itself along the upper edge of said reinvorcing boards.

9. The waterbed perimeter support means of claim 1 wherein said flat surface is a rectangular deckboard with a deck edge adjacent to the bladder perimeter and wherein said frame base member further comprises a skirt attached to the lateral portion at the connection between the lower and lateral portions, said skirt providing a means to cover said deck edge.

10. In a waterbed of the type having a rectangular water bladder to rest on a flat surface and support means around the bladder perimeter, the improvement wherein said support means comprises:

a frame base member formed of a dimensionally-stable pliant sheet extending continuously along at least three sides of the bladder perimeter, said sheet having a lower portion sandwiched between the bladder and the flat surface and a lateral portion connected thereto and extending upwardly therefrom adjacent to the bladder perimeter;

rigid elongated reinforcing boards along the lateral portion of the frame base member, each of said boards extending lengthwise along a side of the bladder perimeter and widthwise from a lower edge near the flat surface upwardly to an upper edge between the flat surface and the bladder top, said boards having inside surfaces against which the outward force of the bladder is applied, said lateral portion of the frame base member having two layers forming a compartment along each side, each said compartment substantially enveloping and holding one of the reinforcing boards; and resiliently-deformable elongated upper members extending lengthwise along each of the boards and widthwise upwardly from the boards to top edges along the bladder top.

11. The waterbed of claim 10 wherein the elongated upper members extend upwardly against the inside surface of said boards, the upper members being connected to the boards near the lower edges thereof.

12. The waterbed of claim 11 wherein the elongated upper members each include a thin resiliently-deformable stiffener, said stiffeners each including a proximal portion overlapping the board to which it is attached and a distal portion thereabove, said distal portion being bendable outwardly against the upper edge of said board and said proximal and distal portions together being bendable inwardly about the interconnection of the board and stiffener.

13. The waterbed of claim 12 wherein each of the upper members includes padding over the stiffener along the top edge and a wrapper around the padding and stiffener, the wrappers of adjacent upper members being joined at their common corners.

14. The waterbed of claim 13 further comprising stiff corner members beneath the joined wrappers, said corner members having a pair of slots receiving the stiffeners of adjacent upper members.

15. The waterbed of claim 14 wherein the stiffeners are freely slideable within the corner members.

16. The waterbed means of claim 10 extending continuously along all four sides of the bladder perimeter.

17. The waterbed of claim 10 wherein the two layers of the lateral portion are formed of a single sheet turned back on itself along the upper edge of said reinforcing boards.

18. The waterbed of claim 17 wherein said flat surface a rectangular deckboard with a deck edge adjacent to the bladder perimeter and wherein said frame base member further comprises a skirt attached to the lateral portion at the connection between the lower and lateral portions, said skirt providing a means to cover said deck edge.

* * * * *